US007752817B2

(12) United States Patent
Pilz et al.

(10) Patent No.: US 7,752,817 B2
(45) Date of Patent: Jul. 13, 2010

(54) TWO-PIECE TRACK SYSTEM

(75) Inventors: Don A. Pilz, Livermore, CA (US); Raymond E. Poliquin, City of Industry, CA (US); Fernando Hernandez Sesma, City of Industry, CA (US)

(73) Assignee: California Expanded Metal Products Company, City of Industry, CA (US)

( * ) Notice: Subject to any disclaimer, the term of this patent is extended or adjusted under 35 U.S.C. 154(b) by 0 days.

(21) Appl. No.: 12/040,658

(22) Filed: Feb. 29, 2008

(65) Prior Publication Data

US 2009/0038764 A1 Feb. 12, 2009

Related U.S. Application Data

(60) Provisional application No. 60/954,029, filed on Aug. 6, 2007.

(51) Int. Cl.

| | |
|---|---|
| ***E06B 1/04*** | (2006.01) |
| ***E04C 2/00*** | (2006.01) |
| ***E04C 3/00*** | (2006.01) |
| ***E04H 1/00*** | (2006.01) |

(52) U.S. Cl. ..... 52/207; 52/241; 52/232; 52/48.1; 52/483.1; 52/730.1; 52/730.6; 52/844; 52/846; 52/848

(58) Field of Classification Search ..... 52/207, 52/241, 232, 48.1, 483.1, 730.1, 730.6, 844, 52/846, 848

See application file for complete search history.

(56) References Cited

U.S. PATENT DOCUMENTS

| | | | | |
|---|---|---|---|---|
| 2,218,426 A | * | 10/1940 | Hurlbert, Jr. | 52/290 |
| 2,683,927 A | | 7/1954 | Maronek | |
| 2,733,786 A | | 2/1956 | Drake | |
| 3,481,090 A | * | 12/1969 | Lizee | 52/241 |
| 3,537,219 A | | 11/1970 | Navarre | |
| 3,566,559 A | * | 3/1971 | Dickson | 52/126.4 |
| 3,744,199 A | * | 7/1973 | Navarre | 52/481.2 |
| 3,935,681 A | | 2/1976 | Voiturier et al. | |

(Continued)

FOREIGN PATENT DOCUMENTS

| | | |
|---|---|---|
| CA | 2234347 | 10/1999 |

(Continued)

OTHER PUBLICATIONS

FireStik™ by CEMCO Brochure, published on www.firestik.us, in 18 pages.

(Continued)

*Primary Examiner*—Richard E Chilcot, Jr.
*Assistant Examiner*—Mark R Wendell
(74) *Attorney, Agent, or Firm*—Knobbe, Martens, Olson & Bear LLP

(57) ABSTRACT

The present invention is directed toward a track assembly comprising two nested tracks, an inner track and outer track. The assembly is designed so that the outside width of the outer track is equal to or less than the outside width of the inner track to present a substantially flush external surface for attachment of exterior sheathing elements when the assembly is used in an external wall. The system may further comprise a strap or series of engaging surfaces on the inner and outer tracks that generally restrain the inner track relative to the outer track.

14 Claims, 5 Drawing Sheets

U.S. PATENT DOCUMENTS

| | | | | | |
|---|---|---|---|---|---|
| 3,955,330 | A | | 5/1976 | Wendt | |
| 3,964,214 | A | | 6/1976 | Wendt | |
| 4,011,704 | A | | 3/1977 | O'Konski | |
| 4,103,463 | A | * | 8/1978 | Dixon | 52/126.4 |
| 4,130,972 | A | | 12/1978 | Varlonga | |
| 4,164,107 | A | | 8/1979 | Kraemling et al. | |
| 4,283,892 | A | | 8/1981 | Brown | |
| 4,329,820 | A | * | 5/1982 | Wendt | 52/241 |
| 4,649,089 | A | | 3/1987 | Thwaites | |
| 4,672,785 | A | * | 6/1987 | Salvo | 52/241 |
| 4,709,517 | A | * | 12/1987 | Mitchell et al. | 52/36.6 |
| 4,723,385 | A | | 2/1988 | Kallstrom | |
| 4,787,767 | A | * | 11/1988 | Wendt | 403/187 |
| 4,825,610 | A | * | 5/1989 | Gasteiger | 52/217 |
| 5,010,702 | A | * | 4/1991 | Daw et al. | 52/241 |
| 5,103,589 | A | * | 4/1992 | Crawford | 49/125 |
| 5,125,203 | A | * | 6/1992 | Daw | 52/241 |
| 5,127,203 | A | * | 7/1992 | Paquette | 52/241 |
| 5,127,760 | A | * | 7/1992 | Brady | 403/230 |
| 5,146,723 | A | * | 9/1992 | Greenwood et al. | 52/288.1 |
| 5,157,883 | A | * | 10/1992 | Meyer | 52/357 |
| 5,222,335 | A | * | 6/1993 | Petrecca | 52/105 |
| 5,285,615 | A | | 2/1994 | Gilmour | |
| 5,325,651 | A | * | 7/1994 | Meyer et al. | 52/715 |
| 5,374,036 | A | | 12/1994 | Rogers et al. | |
| 5,394,665 | A | * | 3/1995 | Johnson | 52/241 |
| 5,412,919 | A | * | 5/1995 | Pellock et al. | 52/656.1 |
| 5,452,551 | A | | 9/1995 | Charland et al. | |
| 5,456,050 | A | | 10/1995 | Ward | |
| 5,471,805 | A | | 12/1995 | Becker | |
| 5,592,796 | A | * | 1/1997 | Landers | 52/241 |
| 5,644,877 | A | * | 7/1997 | Wood | 52/241 |
| 5,687,538 | A | | 11/1997 | Frobosilo et al. | |
| 5,689,922 | A | * | 11/1997 | Daudet | 52/210 |
| 5,755,066 | A | * | 5/1998 | Becker | 52/241 |
| 5,787,651 | A | | 8/1998 | Horn et al. | |
| 5,797,233 | A | * | 8/1998 | Hascall | 52/481.1 |
| 5,806,261 | A | * | 9/1998 | Huebner et al. | 52/283 |
| 5,913,788 | A | * | 6/1999 | Herren | 52/241 |
| 5,921,041 | A | | 7/1999 | Egri, II | |
| 5,927,041 | A | * | 7/1999 | Sedlmeier et al. | 52/836 |
| 5,930,963 | A | | 8/1999 | Nichols | |
| 5,950,385 | A | | 9/1999 | Herren | |
| 6,058,668 | A | | 5/2000 | Herren | |
| 6,176,053 | B1 | | 1/2001 | St. Germain | |
| 6,189,277 | B1 | * | 2/2001 | Boscamp | 52/317 |
| 6,213,679 | B1 | | 4/2001 | Frobosilo et al. | |
| 6,216,404 | B1 | | 4/2001 | Vellrath | |
| 6,233,888 | B1 | * | 5/2001 | Wu | 52/207 |
| 6,374,558 | B1 | * | 4/2002 | Surowiecki | 52/241 |
| 6,430,881 | B1 | * | 8/2002 | Daudet et al. | 52/92.2 |
| 6,647,691 | B2 | * | 11/2003 | Becker et al. | 52/656.1 |
| 6,783,345 | B2 | | 8/2004 | Morgan et al. | |
| 6,799,404 | B2 | * | 10/2004 | Spransy | 52/582.1 |
| 6,843,035 | B1 | * | 1/2005 | Glynn | 52/573.1 |
| 6,854,237 | B2 | | 2/2005 | Surowiecki | |
| 6,871,470 | B1 | | 3/2005 | Stover | |
| 7,152,385 | B2 | * | 12/2006 | Morgan et al. | 52/745.05 |
| 7,240,905 | B1 | | 7/2007 | Stahl, Sr. | |
| 7,617,643 | B2 | | 11/2009 | Pilz et al. | |
| 2002/0170249 | A1 | * | 11/2002 | Yulkowski | 52/210 |
| 2004/0010998 | A1 | | 1/2004 | Turco | |
| 2004/0045234 | A1 | | 3/2004 | Morgan et al. | |
| 2004/0211150 | A1 | | 10/2004 | Bobenhausen | |
| 2006/0123723 | A1 | | 6/2006 | Weir et al. | |
| 2006/0137293 | A1 | | 6/2006 | Klein | |
| 2007/0068101 | A1 | | 3/2007 | Weir et al. | |
| 2008/0087366 | A1 | | 4/2008 | Yu et al. | |
| 2008/0134589 | A1 | | 6/2008 | Abrams et al. | |
| 2008/0172967 | A1 | | 7/2008 | Hilburn | |
| 2008/0250738 | A1 | * | 10/2008 | Howchin | 52/235 |
| 2009/0049777 | A1 | | 2/2009 | Pilz et al. | |
| 2009/0049781 | A1 | | 2/2009 | Pilz et al. | |
| 2009/0090074 | A1 | | 4/2009 | Klein | |
| 2009/0094912 | A1 | | 4/2009 | Klein | |
| 2009/0178363 | A1 | | 7/2009 | Pilz et al. | |
| 2009/0178369 | A1 | | 7/2009 | Pilz et al. | |

FOREIGN PATENT DOCUMENTS

| | | |
|---|---|---|
| GB | 2411212 | 8/2005 |
| WO | WO 03/038206 | 5/2003 |
| WO | WO 2007/103331 | 9/2007 |

OTHER PUBLICATIONS

Order form from Stockton Products for Soffit Vent / Reveal Screed, in 1 page.

DoubleTrack™ information sheets by Dietrich Metal Framing, in 2 pages.

Catalog page from Stockton Products, printed from www.stocktonproducts.com, on Dec. 16, 2007, showing #5 Drip, in 1 page.

International Search Report for Application No. PCT/US2008/073920, dated Apr. 9, 2009.

* cited by examiner

TWO-PIECE TRACK SYSTEM

RELATED APPLICATIONS

This application claims benefit under 35 U.S.C. §119(e) to U.S. Provisional Patent Application No. 60/954,029, filed Aug. 6, 2007. Also incorporated herein in their entireties by reference are U.S. application Ser. No. 12/013,361 entitled Fire Rated Wall Construction Product, filed Jan. 11, 2008, and U.S. application Ser. No. 12/039,685 entitled Exterior Wall Construction Product, filed Feb. 28, 2008.

BACKGROUND OF THE INVENTION

1. Field of the Invention

This application is directed toward a two-piece track system for use in building construction, particularly for use in the interior and/or exterior wall of a building.

2. Description of the Related Art

Two-piece track systems for use in building construction are generally well known, as are two-piece track systems for use in the exterior and/or interior wall of a building that allow for independent environmental movement of the tracks relative to one another. Two-piece track systems generally resemble both an outer U-shaped (or some other similar shaped) elongated tube, or track, and an inner U-shaped (or some other similar shaped) elongated tube, or track. The inner track is designed to receive or cover the ends of wall studs, and the outer track is designed to receive the inner track.

In two-piece track systems, independent movement of the tracks is desirable. The inner track is generally not confined in all directions, and thus is able to move independently from the outer track. Often times in use, the inner track is able to generally slide alongside the outer track in a horizontal or lateral direction relative to the outer track. In those areas of the world where earthquakes are common, this lateral or horizontal movement is important. If the inner track were not allowed to move freely in a generally lateral or horizontal direction, the stability of the wall and the building might be compromised.

In building construction it is not uncommon to have pieces of sheathing, or facade, attached to the outside of the building. These pieces of sheathing generally extend vertically alongside and down the exterior portion of the tracks and wall studs. The pieces of sheathing are attached to the tracks and/or wall studs by some connection means such as a screw or screws. In current two-piece track systems, the outer track's greatest width is larger than the inner track's greatest width. This creates an uneven outer surface for attachment of the sheathing. As a result, often sheathing elements flare out at their ends to accommodate for the uneven surface created by the different track widths.

Also, it is often difficult to keep the inner track from pulling or slipping away relative to the outer track. In current two-piece track systems, screws are used to hold the outer and inner tracks in place during construction. If these screws are not removed after the wall is framed, the inner track will not be able to move as is desired.

SUMMARY OF THE INVENTION

The present invention is directed toward a system that comprises two nested tracks that improve over the prior art. The system comprises an inner track configured to receives a plurality of wall studs therewithin, and an outer track configured to receives the inner track within the outer track. The outer track is configured so that its greatest width is equal to or less than the greatest width of the inner track, thus presenting a general flush surface for attachment of sheathing to the track when the system is used in an exterior wall. In some embodiments, the track flanges may comprises a plurality of angled surfaces to permit a mating nesting arrangement that has an added benefit of preventing separation of the two tracks once nested. The system may further comprise a strap or series of engaging surfaces on the inner and outer tracks that generally restrain the inner track relative to the outer track in addition and/or in lieu of angled flange surfaces.

BRIEF DESCRIPTION OF THE DRAWINGS

These and other features, aspects and advantages of the various devices, systems and methods presented herein are described with reference to drawings of certain embodiments, which are intended to illustrate, but not to limit, such devices, systems, and methods. It is to be understood that the attached drawings are for the purpose of illustrating concepts of the embodiments discussed herein and may not be to scale.

DETAILED DESCRIPTION OF THE PREFERRED EMBODIMENT

Figure 1:
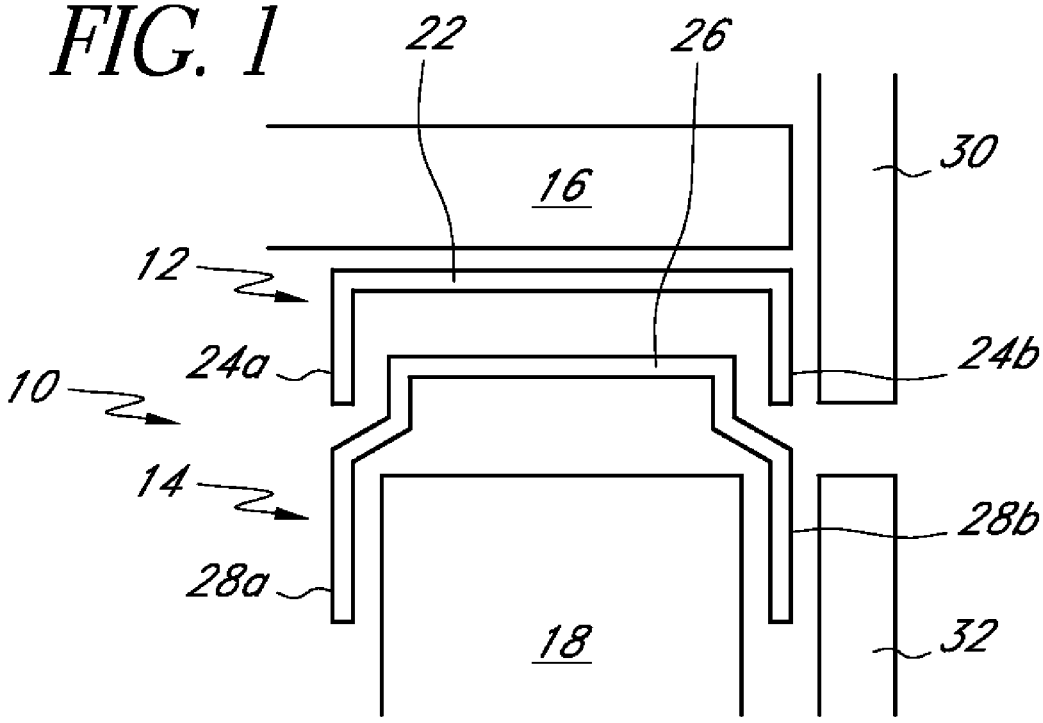
FIG. 1 illustrates a cross-sectional schematic view of one embodiment of the present inventive two-piece track assembly as applied to an exterior wall.

Referring to FIG. 1, a first embodiment of the inventive track assembly 10 comprises a first outer track 12 and a second nested track 14 therewithin. The track assembly is configured to be attached via one of various known fastening means to a ceiling surface 16 of a building and to engage a plurality of vertical stud members 18. The outer track 12 comprises a web 22 and two side flanges 24*a* and 24*b*. Similarly, the inner track 14 comprises a web 26 and two side flanges 28*a* and 28*b*. The outer and inner tracks 12, 14 are matingly configured so that the inner track 14 can nest within the outer track 12 when assembled to prevent generally side-to-side movement but permit relative lateral movement along the length of the tracks.

It is desirable that the greatest width of the outer track 12 be no greater than the greatest width of the inner track 14; i.e., equal to or less than the greatest width of the inner track 14. In the embodiments shown by example in FIGS. 1 and 2, the widths of the two tracks are substantially equivalent. In these embodiments, the essentially flush configuration is accomplished by flaring the side flanges 28*a* and 28*b* of inner track 14 at their ends to a width equal to that of the outer track.

Although the present invention is applicable to both interior and exterior walls, in the context of an exterior wall specifically, it is contemplated that outer sheathing would be attached to the track assembly 10, with an upper sheathing board 30 and a lower sheathing board 32 positioned below it. By configuring the outer and inner tracks 12, 14 as described herein, the two-piece track system 10 may present a substantially flush surface profile alongside sheathing board 30 and 32, which minimizes flaring of the sheathing boards and creates a desirable building surface. Where the width of the outer track is meaningfully less than the width of the inner track, it is still possible to utilize and attach flat sheathing elements to maintain a flush building profile, although a small gap may exist (not shown) between the flange 24*b* and upper sheathing board 30 undetectable from outside the building.

When applied to a building, the track assembly 10 is secured to the ceiling surface 16 by securing the web 22 of outer track 12 to the ceiling surface by way of conventional fastening means (not shown). The inner track 14 may be slipped into the outer track either by way of a snap fit or other application. When shipped as a combined assembly, each track web 22, 26 comprises aligned holes and/or slots for permitting a fastener to be directed through the inner track web 26 and to engage the web 22 of the outer track 12 to the ceiling surface.

Figure 2:
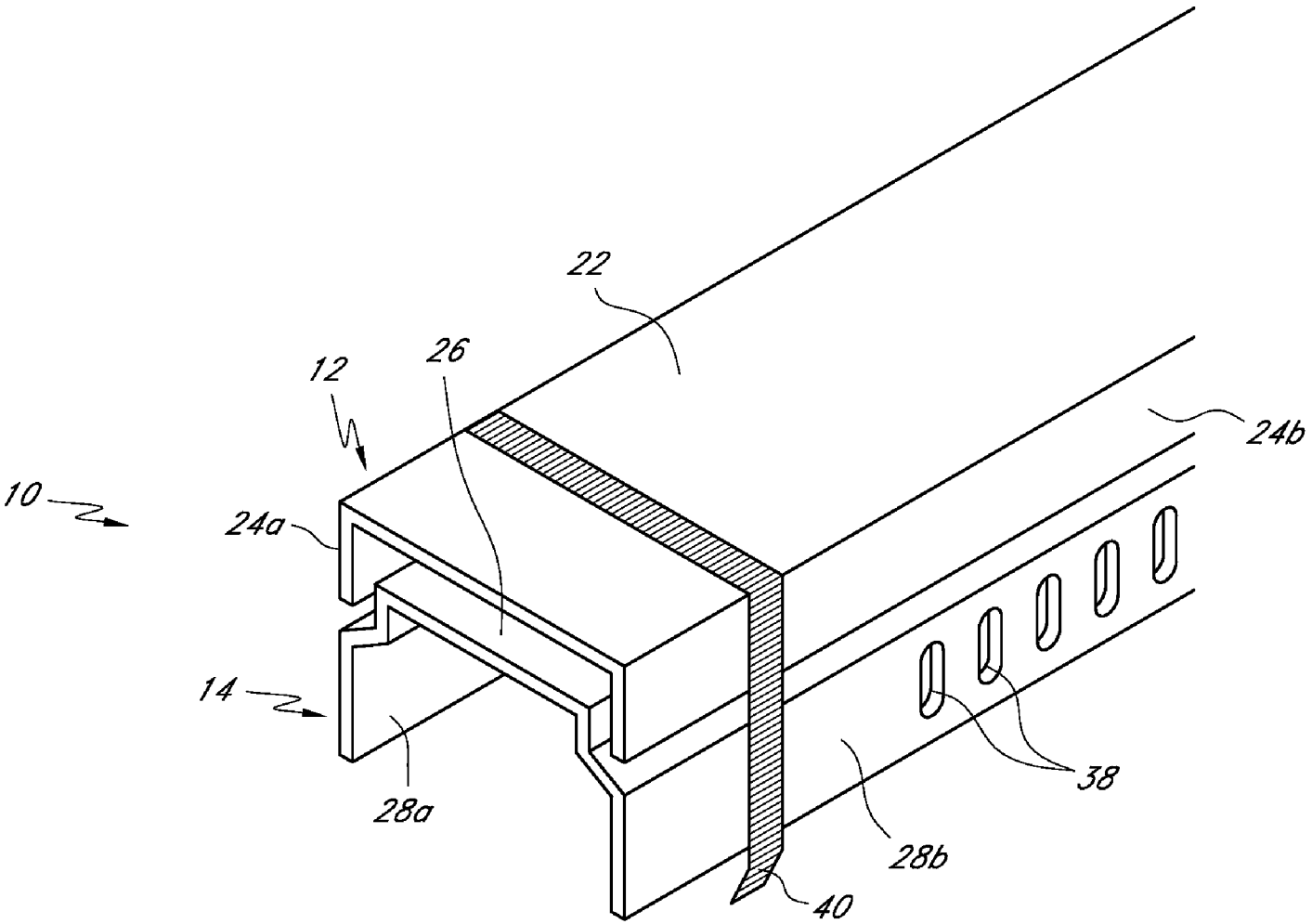
FIG. 2 illustrates a perspective schematic view of another embodiment of the inventive two-piece track assembly.

In current two-piece track systems, it is often necessary to use screws or similar devices to hold the two tracks together during installation or building construction. If the screws are not eventually pulled out after the wall is framed, the screws that were installed will prevent the inner track from being able to move independently from the outer track. One embodiment of the present invention overcomes this deficiency. Referring to FIG. 2, another embodiment of the invention comprises the two-piece track system 10 of FIG. 1 further comprising a plurality of slots 38 along side flange 28*b* to permit vertical movement of the stud members 18 relative to the track assembly 10. The embodiment further comprises a setting strap 40 for securing tracks 12 and 14 together during transport and installation. In one application, the strap 40 may be placed over the outer track 12 and extend down along side flanges 24 and 28 of the outer and inner tracks, respectively. Once the inner track 14 is installed within, or relative to, the outer track 12, the setting strap 40 is desirably flared inwardly at its end. This is done to generally restrain the inner track from being pulled away from the outer track, while still allowing for at least some movement of the tracks relative to one another. For each length of track assembly 10, one or more setting straps 40 may be used. Other mechanisms are contemplated for securing the inner and outer tracks together for shipment and/or installation purposes but removed after installation to permit relative lateral movement. Such mechanisms include toggle bolts and other known devices.

Figure 3:
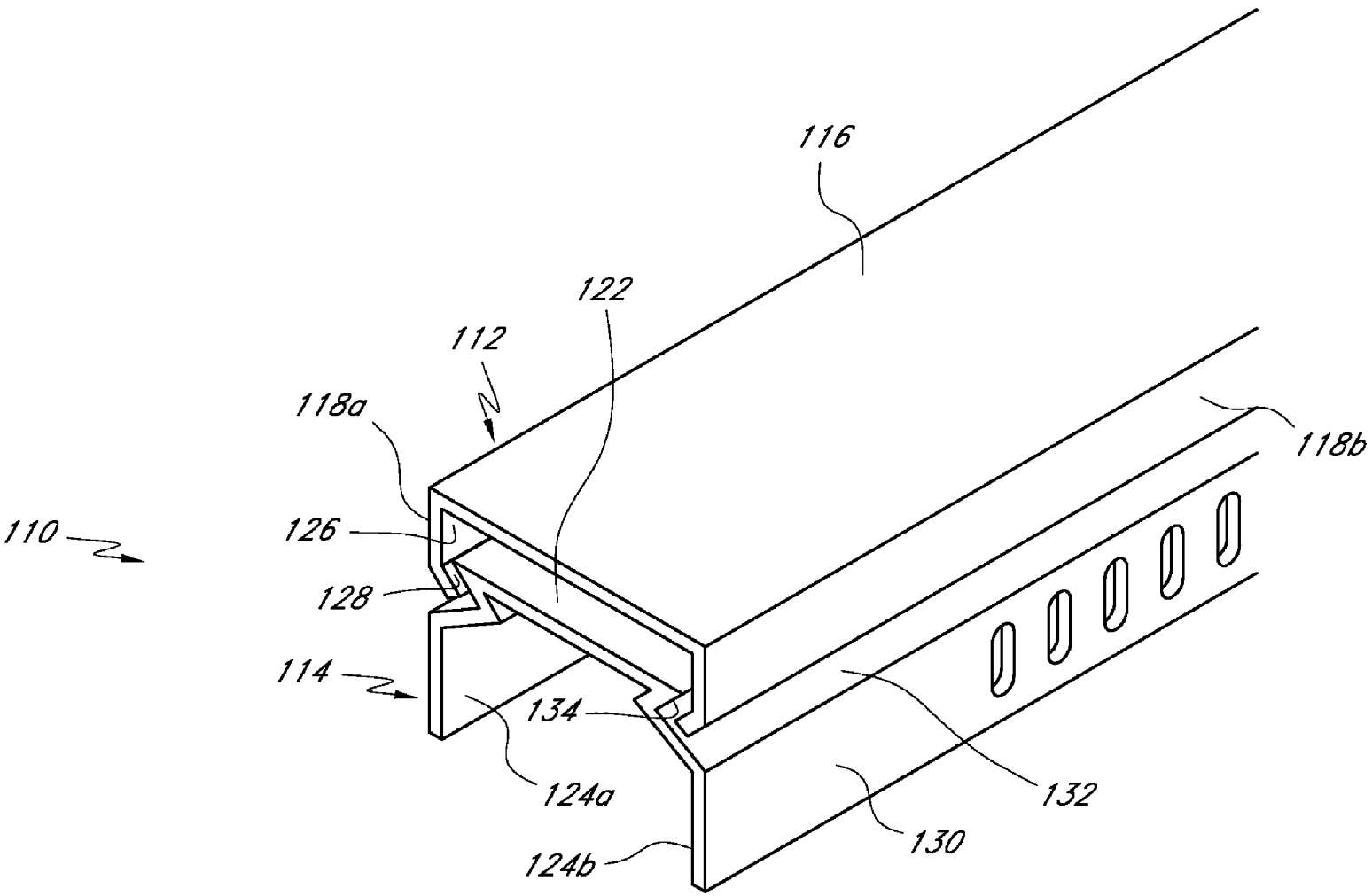
FIG. 3 illustrates a perspective schematic view of another embodiment of the two-piece track assembly.
Figure 4:
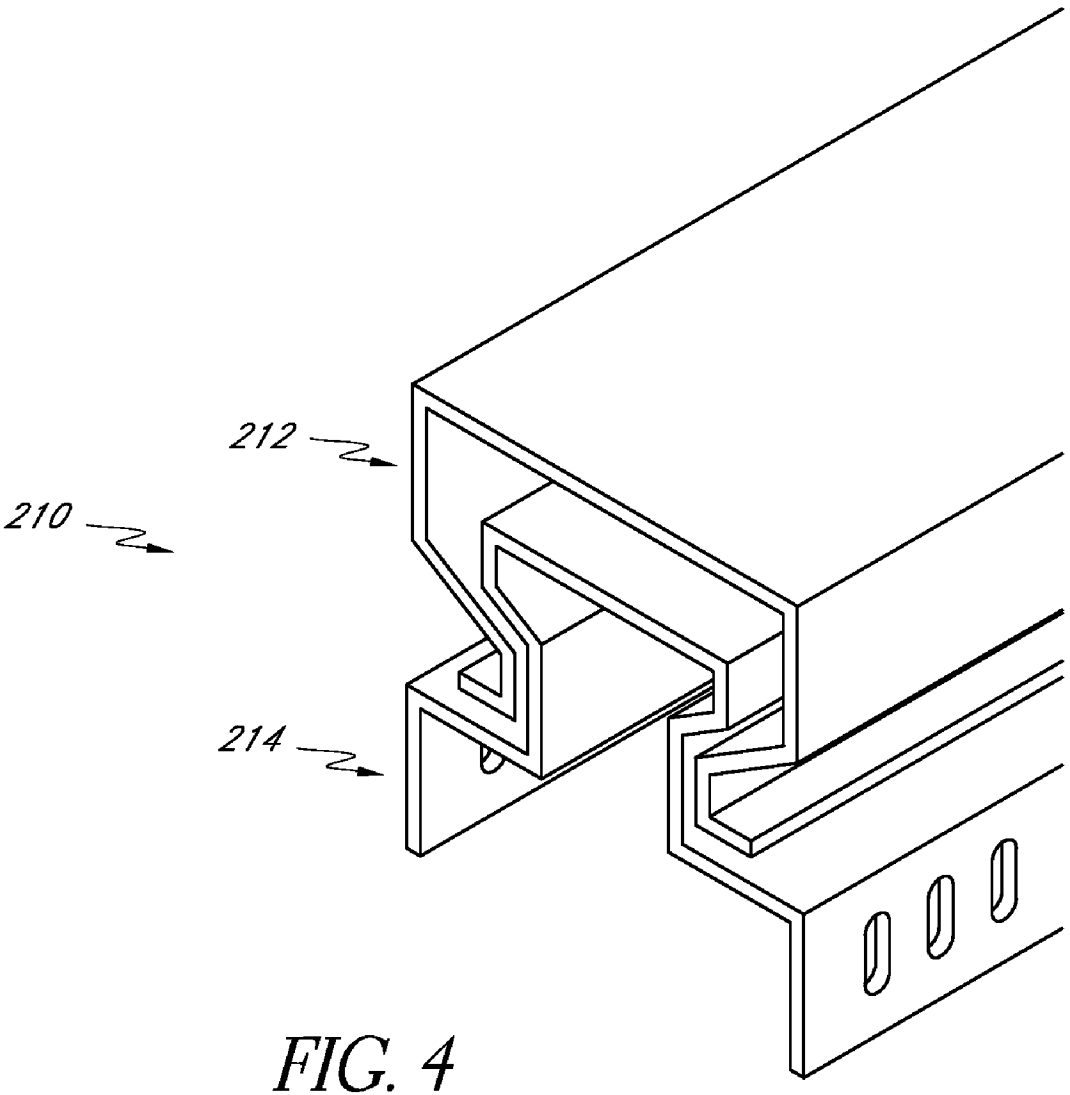
FIG. 4 illustrates a perspective schematic view of another embodiment of the two-piece track assembly.
Figure 5:
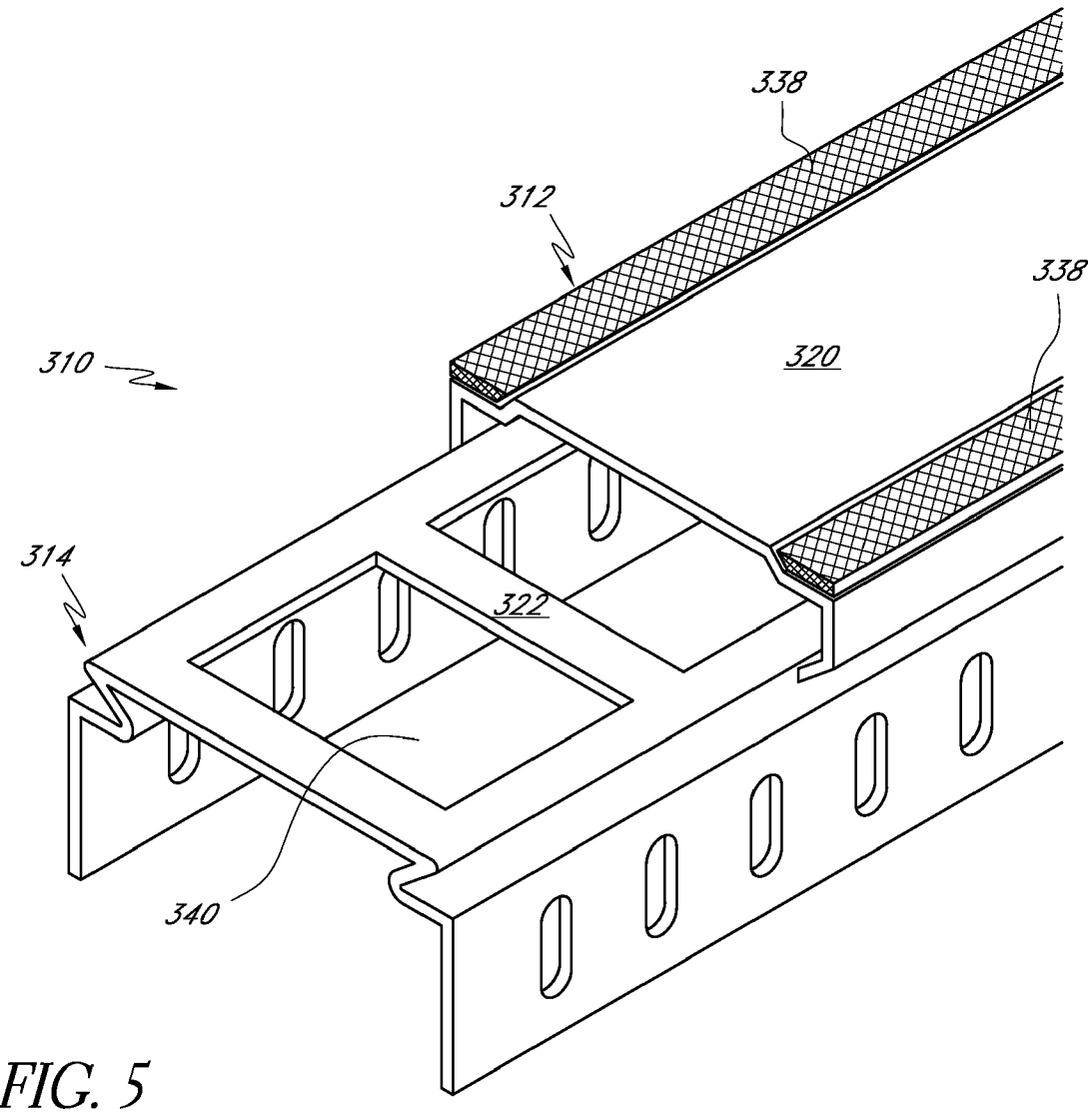
FIG. 5 illustrates a perspective schematic view of another embodiment of the two-piece track assembly.

It is contemplated that the inner and outer tracks may be configured in one of a large number of mating configurations that permit relative lateral movement of the inner track within the outer track and yet preserve the assembly in tact. Examples of other configurations are shown in FIGS. 3-5. In each of these examples, the side flanges comprises multiple angled surfaces that permit mating of the inner and outer tracks in such a way as to restrain the two tracks from being easily pulled apart once nested. By way of example, referring to FIG. 3, an alternative embodiment of a two-piece nested track assembly 110 comprises an outer track 112 and inner track 114. The outer track 112 comprises a web 116 and side flanges 118*a* and 118*b*; the inner track 114 comprises a web 122 and side flanges 124*a* and 124*b*. Side flange 118 comprises a first surface 126 and a second surface 128 angled with respect to first surface 128. Correspondingly, side flange 124 comprises a first surface 130, a second surface 132, and a third surface 134. With such an arrangement, the inner track 114 may be nested within outer track 112 so as to restrain the tracks from being easily pulled apart. They may be shipped as discrete track pieces and snapped in place as a nested assembly. Similarly, FIG. 4 also reflects a plurality of surfaces in the corresponding flanges of outer and inner tracks 212 and 214 so that a mating nested arrangement can be made to make it more difficult to pull the tracks apart.

Referring to FIG. 5, another embodiment of a nested track assembly 310 can include an outer track 312 and inner track 314. The outer track 312 can include a strip or strips of intumescent material 338 attached along portions of the web 320 of outer track 312. In use, the intumescent material 338 can act in helping to prevent fire, smoke, or other debris from moving past the track assembly 310. Additionally, the inner track 314 can include an opening or openings 340 along the web 322 of inner track 314. By incorporating openings 340 in the inner track 314, the weight of inner track 314 can be reduced while still maintaining the structural stability of the track assembly 310.

What is claimed is:

1. A two-piece header track system for use in a stud wall assembly, the stud wall assembly extending in a vertical direction between a lower horizontal support element and an upper horizontal support element, upper ends of a plurality of studs being received by the two-piece header track system, the two-piece header track system comprising:

an elongate inner track comprising a first web and two first flanges, the inner track configured to receive the wall studs therein, the inner track comprising a first width and a second width greater than the first width;

an elongate outer track comprising a second web and two second flanges, the outer track configured to receive the inner track in a nested arrangement therewithin so as to generally restrain side-to-side movement of the inner track but permit relative movement of the inner track along the along the length of the outer track, the outer track having an overall width substantially equal to or less than the second width of the inner track;

further comprising a removable setting strap wrapped at least partially around the tracks for restraining the tracks from being pulled apart in a generally vertical direction when the tracks are in a nested arrangement.

2. The two-piece header track system of claim 1, wherein the first and second flanges comprise a plurality of angled surfaces working in conjunction to restrain the tracks from being pulled apart in a generally vertical direction when the tracks are in a nested arrangement.

3. The two-piece header track system of claim 1, wherein at least one first flange is positioned substantially flush with a corresponding second flange when the tracks are in a nested arrangement.

4. The two-piece header track system of claim 1 further comprising intumescent material applied along at least a portion of the length of the outer track.

5. The two-piece header track system of claim 1, further comprising at least one opening in the first web extending substantially entirely across the first web.

6. The two-piece header track system of claim 1, wherein the inner track comprises an upper portion nested within the outer track and a lower portion for receiving the upper ends of the studs.

7. The two-piece header track system of claim 1, wherein each of the inner and outer tracks is roll-formed from a single piece of material.

8. A two-piece header track system for use in a stud wall assembly, the stud wall assembly extending in a vertical direction between a lower horizontal support element and an upper horizontal support element, upper ends of a plurality of studs being received by the two-piece header track system, the two-piece header track system comprising:

an inner track comprising:

an inner elongate top web portion;

a first inner elongate side flange portion;

a second inner elongate side flange portion, the first and second inner elongate side flange portions extending downward from opposite sides of the inner elongate top web portion, the inner elongate top web portion and first and second inner elongate side flange portions defining a space for receiving the upper ends of the studs, the width of the inner top web portion being less than the greatest width between the first and second inner elongate side flange portions;

an outer track comprising:

an outer elongate top web portion;

a first outer elongate side flange portion;

a second outer elongate side flange portion;

wherein the inner track is at least partially nested in the outer track such that outer surfaces of the first and second inner elongate side flange portions are substantially aligned with outer surfaces of the first and second outer elongate side flange portions;

wherein the inner track comprises an upper portion nested within the outer track and a lower portion for receiving the upper ends of the studs;

wherein the upper portion comprises a first surface and two second surfaces extending from opposite ends of the first surface inwardly towards one another at an acute angle relative to the first surface.

9. The two-piece header track system of claim 8, wherein the first and second inner and outer elongate side flange portions comprise a plurality of angled surfaces working in conjunction to restrain the inner and outer tracks from being pulled apart in a generally vertical direction when the tracks are in a nested arrangement.

10. The two-piece header track system of claim 8, wherein the first and second outer elongate side flange portions of the outer track comprise ends which are curved inwardly towards one another so as to cooperate with the upper portion of the inner track to restrain the inner and outer tracks from being pulled apart in a generally vertical direction when the tracks are in a nested arrangement.

11. The two-piece header track system of claim 10, further comprising intumescent material applied along at least a portion of the length of the outer track.

12. A two-piece header track system for use in a stud wall assembly, the stud wall assembly extending in a vertical direction between a lower horizontal support element and an upper horizontal support element, upper ends of a plurality of studs being received by the two-piece header track system, the two-piece header track system comprising:

an outer track comprising an elongate top web portion and first and second elongate side flange portions extending from opposite sides of the top web portion, the first and second elongate side flange portions each having a bent profile such that the first and second elongate side flange portions generally define inwardly angled surfaces;

an inner track comprising an elongate top web portion nested within the outer track, the inner track further comprising first and second elongate side flange portions extending from opposite sides of the top web portion, the first and second elongate side flange portions each having a bent profile such that the first and second elongate side flange portions generally define inwardly angled surfaces;

wherein the bent profiles of the first and second elongate side flange portions of the outer and inner tracks cooperate to inhibit the inner track from moving relative to the outer track in a side-to-side direction, but permit relative movement of the inner track along the length of the outer track;

wherein the first and second elongate side flange portions comprise a plurality of angled surfaces working in conjunction to restrain the inner and outer tracks from being pulled apart in a generally vertical direction when the tracks are in a nested arrangement;

wherein the upper portion comprises a first, horizontal surface and two second surfaces extending from opposite ends of the first surface inwardly towards one another at an acute angle relative to the first surface.

13. The two-piece header track system of claim 12, wherein the inner track comprises an upper portion nested within the outer track and a lower portion for receiving the upper ends of the studs.

14. The two-piece header track system of claim 12, wherein each of the inner and outer tracks is roll-formed from a single piece of material.

* * * * *

UNITED STATES PATENT AND TRADEMARK OFFICE

CERTIFICATE OF CORRECTION

PATENT NO. : 7,752,817 B2
APPLICATION NO. : 12/040658
DATED : July 13, 2010
INVENTOR(S) : Pilz et al.

It is certified that error appears in the above-identified patent and that said Letters Patent is hereby corrected as shown below:

At column 3, line 46, change "in tact." to --intact.--.

At column 4, line 29 (approx.), in Claim 1, change "along the along the" to --along the--.

Signed and Sealed this
Fifth Day of April, 2011

David J. Kappos

David J. Kappos
*Director of the United States Patent and Trademark Office*